United States Patent [19]

Hirano

[11] Patent Number: 4,756,431

[45] Date of Patent: Jul. 12, 1988

[54] RADIO CONTROL AERIAL AUTOMATIC CARRYING SYSTEM

[76] Inventor: Kozo Hirano, Minono-machi 93-1, Hitoyoshi-shi, Kumamoto-ken, Japan

[21] Appl. No.: 2,547

[22] Filed: Jan. 13, 1987

[51] Int. Cl.[4] ..... B66C 21/00

[52] U.S. Cl. ..... 212/76; 212/77; 212/80; 212/122; 212/207

[58] Field of Search ..... 212/71, 76, 77, 80, 212/82, 83, 85, 87, 89, 94, 96, 97, 104, 108, 110, 114, 116, 122, 124, 125, 140, 141, 142.1, 207; 104/112, 165, 173.1; 105/148, 163.1

[56] References Cited

U.S. PATENT DOCUMENTS

| | | | |
|---|---|---|---|
| 266,597 | 10/1882 | Ackerman | 212/80 |
| 3,710,726 | 1/1973 | Buchholz et al. | 212/207 |
| 4,500,004 | 2/1985 | Peters et al. | 212/80 |
| 4,515,281 | 5/1985 | Maki | 212/122 |
| 4,669,619 | 6/1987 | Kimblad | 212/77 |

FOREIGN PATENT DOCUMENTS 57-4596 1/1982 Japan .

*Primary Examiner*—Joseph F. Peters, Jr.
*Assistant Examiner*—Stephen P. Avila
*Attorney, Agent, or Firm*—Flynn, Thiel, Boutell & Tanis

[57] ABSTRACT

There is a radio control aerial automatic carrying system for carrying an object such as cut woods by a carrying apparatus suspended to a cableway. This system comprises: an aerial main cableway suspended in a desired felling region; drive wheels suspended to the aerial main cableway; outer casings coupled to the drive wheels; a power source disposed in the outer casings; hoisting apparatuses which are driven by the power source and hoist the cables to hang up and down the object to be carried; a receiver, provided for the outer casings, for receiving the radio waves transmitted from a transmitter and for generating control commands to drive the power source and hoisting apparatuses in response to the radio waves received; a rotary shaft which is attached to the outer casings and rotated by the power source; sub cableways suspended in parallel with the aerial main cableway; and two drive wheels, attached to the rotary shaft, for moving the carrying apparatus by operating the sub cableways. With this system, the total weight of the carrying apparatus and object is applied to a plurality of portions of the cableways, so that the cut-away thereof is prevented and the object can be safely carried. The hanging and carrying works can be easily performed by the worker at a location away from the felling field by the radio control.

7 Claims, 6 Drawing Sheets

RADIO CONTROL AERIAL AUTOMATIC CARRYING SYSTEM

FIELD OF THE INVENTION

The present invention relates to a radio control aerial automatic carrying system and, more particularly, to a radio control aerial automatic carrying system which is used to carry the woods in the cutover of the forest and can safely convey the woods even in the steep slanting region and can lift and transport and lower objects to be conveyed by respectively individually hoisting up and down a plurality of cables.

DESCRIPTION OF THE RELATED BACKGROUND ART

The aerial cableway is used as the carrying means for carrying the woods from the forest. The woods can be easily conveyed by the aerial cableway in the steep slanting regions such as the regions between the mountains, valleys, and the like. The aerial cableway is constituted by suspending the steel cables between the summit of the mountain having the steep slanting surface and the foot of this mountain or in the valley between the mountains. The carrying apparatus which is operated by the radio wave is suspended from the steel cables, thereby suspending and transporting objects to be conveyed.

Most of the conventional carrying apparatuses are of the type of what is called one-shaft one-body in which one drive is provided to move the carrying apparatus while manually operating the sub cableway. However, when the carrying apparatus is obliquely upwardly moved in the steep slanting district, there is a problem such that the drive wheel slips and the carrying apparatus is not smoothly moved because the friction which is caused between the drive wheel and the sub cableway is small. On the other hand, when the carrying apparatus is moved downwardly, there is a fear of runaway of the carrying apparatus since the braking performance is bad, so that it is dangerous. Further, a large total weight of the carrying apparatus and objects to be conveyed acts on one sub cableway, so that there is a risk that the sub cableway is likely to be cut or broken. Therefore, there is a serious problem in that the carrying apparatus recklessly runs if the sub cableway is cut during the movement in the steep slanting region. Thus, the improvement of the conventional carrying apparatus is demanded.

On the other hand, in the thinning or full felling region, or in the region near those regions where the cableway passes, the hoisting cable and lateral hanging cable are repeatedly vertically lifted up and down, so that many standing trees and the like in those regions are damaged. The positions of the workers who control the operations to pull in and out various cables such as lateral hanging cable, towing cable, hoisting cable, and the like are unconditionally determined on the basis of the suspending of the cables and the function of the conventional carrying apparatus. The workers cannot operate the cables from the unobstructed locations. Consequently, it is very inconvenient and dangerous.

When the conventional carrying apparatus as mentioned above is used, the cables are suspended in the following manner. For example, in the case of carrying the cut woods from a square felling region 201 as shown in FIG. 1, an aerial cableway 202 is first suspended so as to cross the square felling region 201. The woods in the regions just below the cableway 202 and in a hatched portion 203 near that region are cut and conveyed to the road side. After completion of the felling of the woods, one pole 204 is moved by a predetermined distance and another aerial cableway **202*a* is suspended. The woods in the region just below the cableway 202*a* and in a hatched portion 205** near this region are cut and conveyed. In this manner, it is necessary to sequentially suspend the cableways in order to cut down and carry the woods. Therefore, much labors and costs are required to sequentially newly suspend the cableways. The objects to be conveyed cannot be vertically lifted up and down at a desired single position in the carrying region. For example, in the thinning district or the like in the forest when the woods which were thinned out are carried, the remaining standing trees and the cut woods to be conveyed are damaged by the contact, collision, and the like. On the other hand, in the case of conveying the woods by passing through the area above the non-felling region and the like, the forest at the wood passing location is ruined by the lateral hanging cables and hoisting cables for the hooks serving as the means for hanging up objects to be carried and the like. To prevent this, it is necessary to cut down or thin out the woods in a line form in order to form the passages adapted to suspend the cables. In addition, the workers must always exist at the loading positions when the objects to be carried are loaded and the like. Consequently, the conventional carrying apparatus has many drawbacks such that much labors are required, it is dangerous, many workers are necessary, and the like.

FIG. 2 shows another example of the conventional carrying apparatus. In the case of carrying, for example, the cut woods from such an L-shaped configuration of the ground as shown in FIG. 2, there are also many inconveniences similar to the above. The two-stage wood collecting system which needs two main cableways (or the multi-stage wood collecting system in dependence on the configuration of the ground) must be adopted. Thus, in this case, there are large technical and economical drawbacks.

Moreover, if the conventional one-shaft and one-body carrying apparatus having the swing arms is used, the effect of the swing arms can be presented by a certain degree. However, the driving force and braking force lack because of the single body. The movement range along the cableway suspended in accordance with the steep configuration of the ground is extremely limited and the effect of the swing arms cannot be sufficiently obtained. Consequently, there is a drawback such that the sufficient function of the carrying apparatus cannot be presented as a whole.

SUMMARY OF THE INVENTION

The present invention is made to solve the foregoing drawbacks and it is, therefore, an object of the invention to provide a radio control aerial automatic carrying system in which one rotary shaft is provided for the carrying apparatus, at least two drive wheels are provided for the rotary shaft, and each of the drive wheels is equipped with a sub cableway so as to be manually operated, thereby enabling the carrying apparatus to be safely and certainly moved even in the location of the steep slanting region, enabling a plurality of cables to be respectively individually hoisted up and down, and thereby enabling objects to be smoothly lifted and transported and lowered.

This object is accomplished by a radio control aerial automatic carrying system for carrying an object by a carrying apparatus suspended from a cableway, comprising: an aerial main cableway which is suspended in a predetermined felling region; drive wheels suspended from the aerial main cableway; an outer casing coupled to the drive wheels; a power source disposed on the outer casing; hoisting means which is driven by the power source and hoists cables to hang up and down an object to be carried; a receiver, provided on the outer casing, for receiving radio waves which are transmitted from a transmitter and for generating control commands to drive the power source and the hoisting means in response to the radio waves received; a rotary shaft which is attached to the outer casing and rotated by the power source; a sub cableway which is suspended in parallel with the aerial main cableway; and at least two drive wheels, attached to the rotary shaft, for moving the carrying apparatus by engagement with the sub cableway.

With the carrying system of the invention, one rotary shaft is provided, at least two drive wheels are attached to the rotary shaft, and the sub cableway is wound around each drive wheel. Therefore, the frictions which are generated by the drive wheels and sub cableways can be enlarged. When the carrying apparatus is obliquely upwardly moved, the slip of the carrying apparatus and the like can be prevented. When the carrying apparatus is downwardly moved, the carrying apparatus can be effectively braked. The operating performance can be improved. On the other hand, the total weight of the carrying apparatus and object to be conveyed which act on each sub cableway can be reduced. Therefore, the cut-away of the sub cableways can be prevented. Even if one of the sub cableways is cut away, the carrying apparatus can be held at the fixed position by the remaining sub cableways and main cableway, so that the safety is assured. Further, the sub cableways can be selectively wound around desired drive wheels and the use efficiency can be improved.

The above and other objects and features of the present invention will become apparent from the following detailed description and the appended claims with reference to the accompanying drawings.

BRIEF DESCRIPTION OF THE DRAWINGS

FIGS. 9 and 10 illustrate a first embodiment of the present invention, in which FIG. 9 is a front view of a carrying apparatus and FIG. 10 is a perspective view of the state in which the carrying apparatus is suspended.

DESCRIPTION OF THE PREFERRED EMBODIMENTS

Examples of a conventional carrying apparatus will first be described with reference to FIGS. 3–8.

Figure 1:
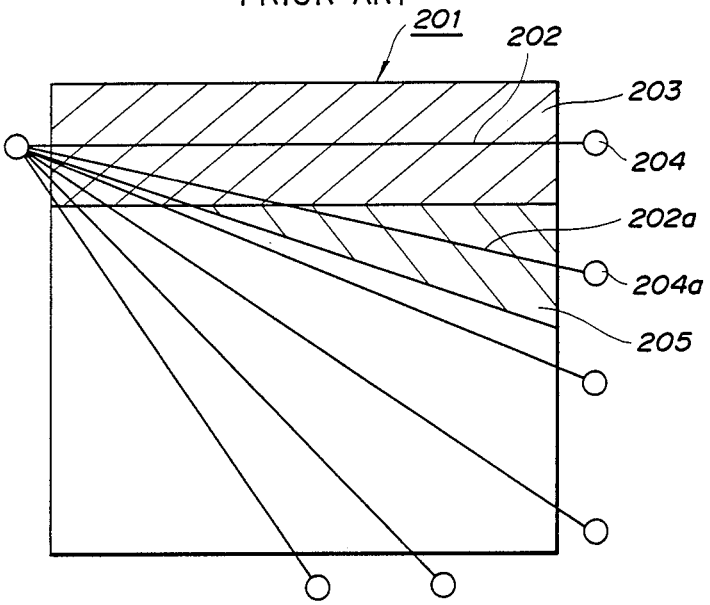
FIG. 1 PRIOR ART
FIG. 1 is a plan view showing a cable suspending state according to a conventional carrying system of objects to be conveyed.
Figure 2:
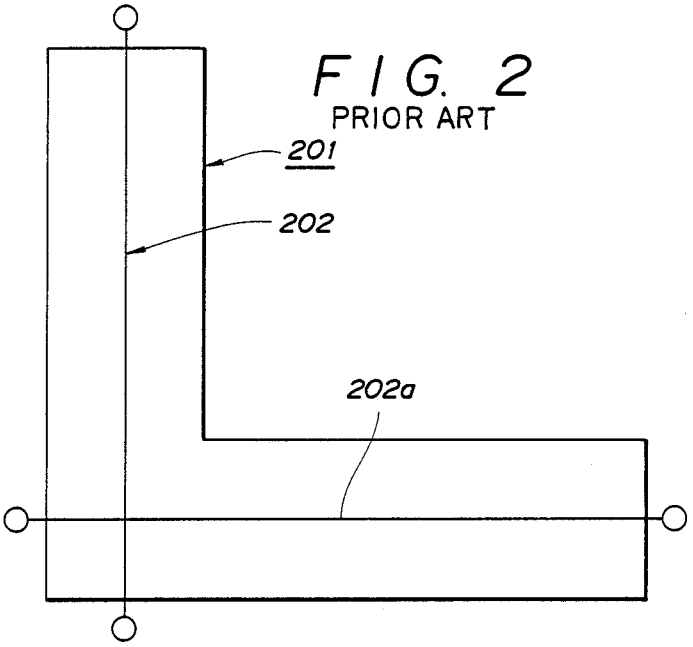
FIG. 2 PRIOR ART
FIG. 2 is a plan view showing a cable suspending state according to another conventional carrying system.
Figure 3:
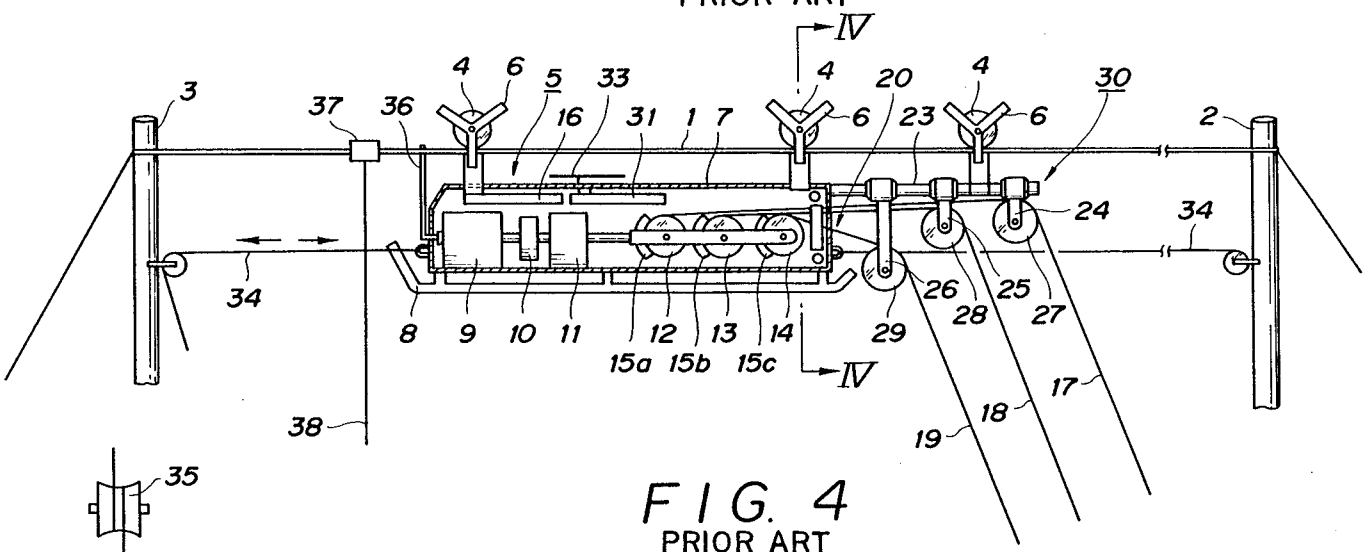
FIG. 3 PRIOR ART
FIG. 3 is a side elevational view with a part cut away showing a radio control carrying system having a plurality of hoisting means according to a conventional system and also showing the portions concerned with this system.
Figure 4:
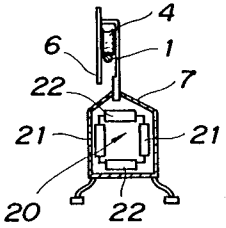
FIG. 4 PRIOR ART
FIG. 4 is a cross sectional view taken along the line IV—IV in FIG. 3.

In FIG. 3, reference numeral 1 denotes a main cableway. The main cableway 1 consists of a wire rope having a diameter of, for example, about 18 to 30 mm in consideration of the sizes of spans and the safety ratio which needs to be set to about 2.7 in the case of hanging and transporting the object having a weight of about one ton. Reference numeral 2 denotes a pole which is fixed on the mountain side and 3 is a pole which is fixed on the carrying side. Although not shown, a number of poles are stood between the poles 2 and 3 as necessary. The main cableway 1 is suspended between the poles 2 and 3. A main carrying apparatus 5 as a carrying system having a plurality of hoisting means is suspended by the main cableway 1 by three pulleys 4 so as to be movable along the main cableway 1. A cableway slip-out preventing metal fitting 6 having projections, for example, in three directions is attached to each pulley 4. As shown in FIG. 4, the main carrying apparatus 5 is covered by an outer casing 7 to prevent the rain, water, dust, and the like from entering the carrying apparatus. A camber 8 for running is attached under the outer casing 7 for convenience when the main carrying apparatus 5 is towed and transported on the ground. On the other hand, a power source 9 consisting of an internal combustion engine such as a gasoline engine or the like having a horsepower of 10 to 15 is disposed in the main carrying apparatus 5. The power source 9 is connected to first to third hoisting means 12, 13, and 14 such as hoisting drums or the like, which are respectively individually operated and driven, through a clutch 10 and a speed change gear apparatus 11 such as an automatic speed change gear. Braking apparatuses 15*a*, 15*b*, and 15*c* are connected to the hoisting means 12 to 14, respectively. Further, a hydraulic apparatus 16 such as a hydraulic cylinder or the like is provided for each of the power source 9, clutch 10, speed change gear apparatus 11, and braking apparatuses 15*a* to 15*c*, thereby driving these apparatuses. First to third cables 17, 18, and 19 are wound around the first to third hoisting means 12 to 14, respectively. The three cables 17 to 19 are pulled out to the outside from a cable outlet 20 formed in the right end of the main carrying apparatus 5 in FIG. 3. As shown in FIG. 4, the cable outlet 20 is constituted by two vertical guide rollers 21 and two lateral guide rollers 22, thereby enabling the cables to be easily, safely, and smoothly pulled in and out.

On the other hand, in the right end upper portion of the main carrying apparatus 5 in FIG. 3, a supporting rod 23 is attached on the right side, namely, so as to be projected in almost parallel with the main cableway 1. Three first to third swing arms 24, 25, and 26 are attached to the supporting rod 23 substantially perpendicularly to the longitudinal direction of the rod 23 in a manner such that the swing arms 24 to 26 can swing in the plane which is almost perpendicular to the longitudinal direction of the rod 23. First to third guide pulleys 27, 28, and 29 are attached to the tips of the swing arms 24 to 26, respectively. The guide pulleys 27 to 29 lead and guide the cables which are wound around the hoisting means and which are pulled in and out. Cableway guiding means 30 of the first to third cables 17 to 19 is constituted by the supporting rod 23, swing arms 24 to 26, and guide pulleys 27 to 29. On the other hand, a pulley adapted to be suspended to the main cableway 1 is attached to the supporting rod 23.

A receiver 31 to receive the radio wave is disposed in the main carrying apparatus 5. A control command received by the receiver 31 is transmitted to each hydraulic apparatus 16, thereby allowing the hydraulic apparatuses 16 to perform the operations such as start, acceleration, and stop of the power source 9, the connection and removal of the clutch 10, and switching of the speed change gear apparatus 11. Those control commands are transmitted from a transmitter 32 to the receiver 31 by way of the radio waves on the basis of the operation of the operator who is working at the safe unobstructed location on the ground. The foregoing various kinds of different commands to instruct the start of the engine, connection and removal of the clutch, and the like are transmitted by the radio waves of the single frequency. However, desired various kinds of different commands can be also transmitted to the remote receiver 31 by variably modulating and transmitting the radio waves in a well-known manner. Numeral 33 denotes a receiving antenna.

The edge of a towing cable 34 to tow and move the main carrying apparatus 5 is fixed to the edge portions before and after the main carrying apparatus 5, thereby constituting the endless cable. The towing cable 34 is wound around a drum 35 for endless use. Further, in the left end portion of the main carrying apparatus 5 in FIG. 3, a contact shoe 36 is projected so as to connect or disconnect a power source which is used for the receiver 31. On the other hand, a contact member 37 adapted to be come into contact with the contact shoe 36 is attached to the portion of the main cableway 1 locating near the pole 3 on the carrying side. An operating cable 38 vertically depends from the contact member 37 to the ground. The contact member 37 is moved by operating the cable 38.

In addition, the main carrying apparatus 5 is equipped with well-known reverse movement preventing means for, for example, stopping the towing cable 34 in order to prevent that the main carrying apparatus 5 is moved by the tension of a supporting cable, which will be explained hereinafter, when the supporting cable is suspended by stopping the main carrying apparatus 5 at a desired position.

A first example of the operation to suspend the cables by use of the foregoing radio control main carrying apparatus 5 will now be described.

Figure 5:
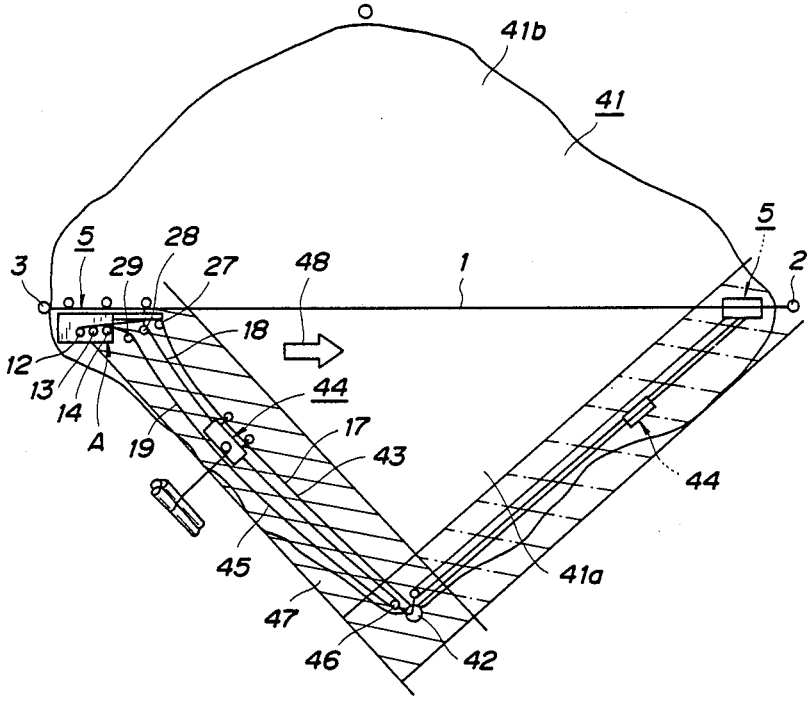
FIG. 5 PRIOR ART
FIG. 5 is a plan view showing a first example of a cable suspending system using the carrying apparatus according to the conventional system.

In FIG. 5, reference numeral 41 denotes a felling region of the woods. In order to convey the cut woods in the whole region of the felling region 41 due to the thinning or full felling, the pole 2 on the mountain side and the pole 3 on the carrying side are first stood and fixed and the main cableway 1 is suspended so as to cross the region 41. Next, the main carrying apparatus 5 is suspended to the main cableway 1. A lead rope (not shown) having a small diameter is fastened to the edge of the first cable 17 and wound around the first guide pulley 27 and vertically put down to the ground in order to feed out the first cable 17 from the first hoisting means 12. The lead rope is pulled out to the position of a side pole 42 so as to cross the felling region 41. The first cable 17 is fastened to the side pole 42. In this manner, a supporting cable 43 is completely suspended. A sub carrying apparatus 44 is attached to the supporting cable 43 so that it can run along the supporting cable 43. The sub carrying apparatus 44 is constituted in a manner substantially similar to the main carrying apparatus 5 mentioned above excluding that it has only one hoisting means consisting of a drum or the like and does not have the foregoing cable guiding means. Namely, the sub carrying apparatus 44 can hoist up and down the woods or the like on the basis of a radio signal. The second and third cables 18 and 19 extending from the second and third hoisting means 13 and 14 of the main carrying apparatus 5 are fastened as a supporting towing cable 45 to the sub carrying apparatus 44. The third cable 19 is wound through a pulley 46 disposed near the side pole 42, thereby enabling the sub carrying apparatus 44 to be reciprocated on the supporting cable 43. With such a cable suspending constitution, if the main carrying apparatus 5 is disposed at a position A shown in FIG. 5, the cut woods can be conveyed in the region just below the supporting cable 43 and the region near this supporting cable as shown in a hatched portion 47. Therefore, by sequentially moving the main carrying apparatus 5 along the main cableway 1 in the direction indicated by an arrow 48 in FIG. 5, all of the lower half region **41*a* of the felling region 41 can be covered. The cut woods in the lower half region 41*a* can be easily collected just below or near the main cableway 1. Similarly, the cut woods in the upper half region 41*b* of the felling region 41 in FIG. 5 can be also easily collected. The cut woods collected just below or near the main cableway 1 can be fairly easily conveyed to the position of the pole 3 on the carrying side owing to the mobility of the main carrying apparatus 5** in a well-known manner.

Figure 6:
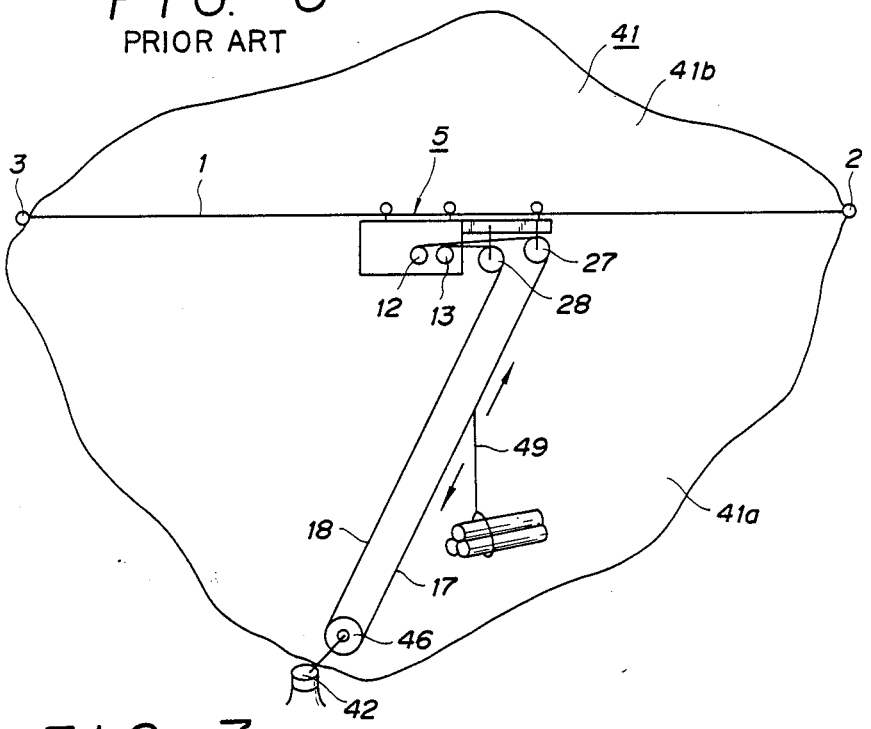
FIG. 6 PRIOR ART
FIG. 6 is a plan view showing a second example of the conventional system.

FIG. 6 shows the second example of the conventional apparatus. In this example, the parts and components having the same functions as those described in the first example are designated by the same reference numerals and will be explained hereinbelow.

It is a feature of the second example that the two first and second hoisting means 12 and 13 are provided in the main carrying apparatus 5 and the aerial cableway adapted to cover the whole felling region is realized by only the two cables 17 and 18 in a manner similar to the first example.

Namely, one end of the first cable 17 is connected to one end of the second cable 18 so as to constitute a single cable. The other ends of the cables 17 and 18 are wound around the first and second hoisting means 12 and 13. The cables 17 and 18 are suspended so as to cross the felling region 41 through the pulley 46 of the side pole 42. A suspending apparatus 49 such as a hook or the like to suspend objects to be carried is attached to the cables 17 and 18. In other words, the cables 17 and 18 are constituted as the single cable alternate running system such that a single cable reciprocates. One fulcrum of the cables 17 and 18 is located on the main carrying apparatus 5, thereby enabling the main carrying apparatus 5 to be freely moved. In the case of suspending the objects to be conveyed such as the woods or the like to the suspending apparatus 49, the cable is loosened by reversely rotating the first or second hoisting means 12 or 13, thereby allowing the suspending apparatus 49 to reach the ground.

Figure 7:
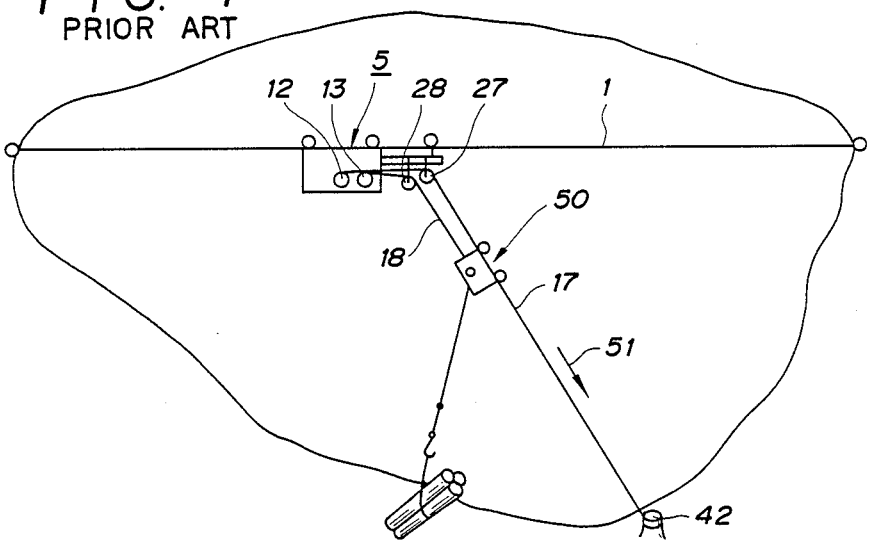
FIG. 7 PRIOR ART
FIG. 7 is a plan view showing a third example of the conventional system.

FIG. 7 shows the third example as the modified form of the second example of the conventional system. The third example is used in the case where the configuration of the ground, in particular, is slanted and the ground on the side of the side pole 42 is lower.

It is a feature of the third example that the first cable 17 is used as the supporting cable and a carrying apparatus 50 is suspended to this supporting cable and the second cable 18 is wound in the carrying apparatus 50. With this constitution, when the objects to be conveyed are hung up, the inclined portion of the carrying apparatus 50 whose edge is downwardly located moves by its weight in the direction indicated by an arrow 51 in FIG. 5, i.e., in the direction of the side pole 42. Thus, the carrying apparatus 50 can reach a desired location. The carrying apparatus 50 can be easily moved in the direction of the main cableway 1 by winding the second cable 18.

Figure 8:
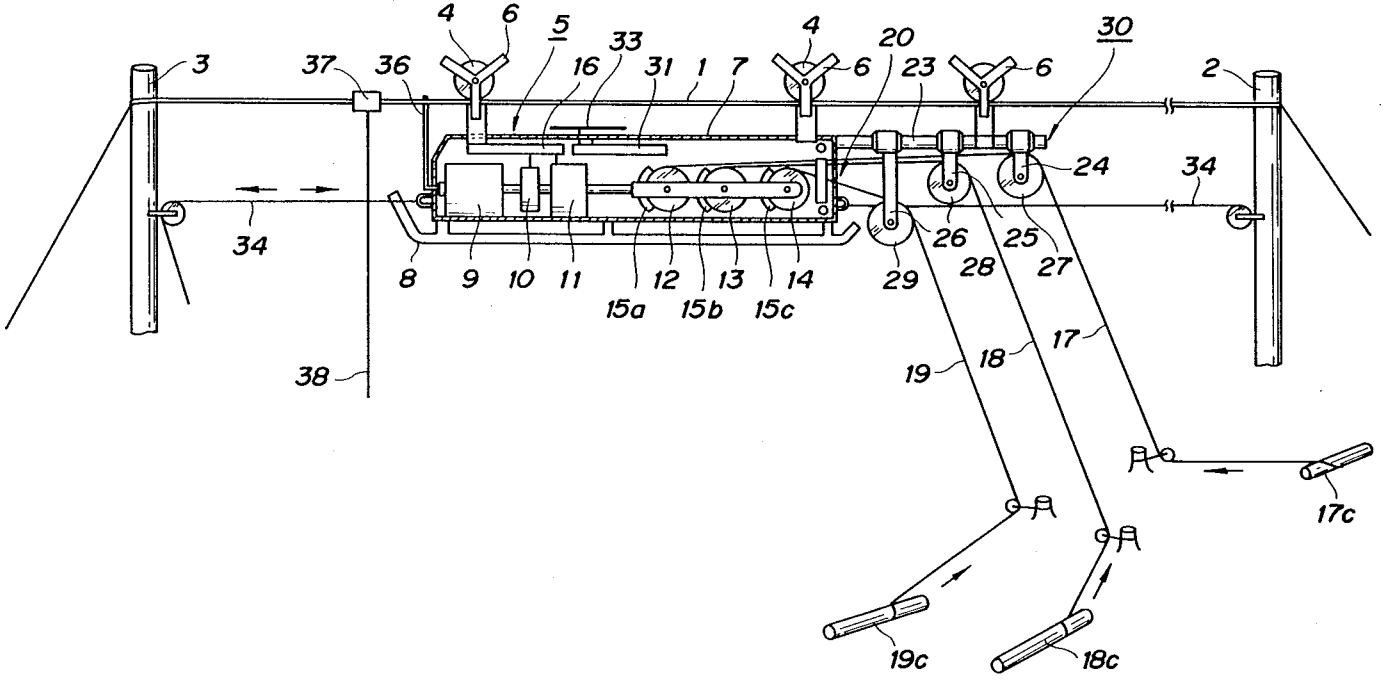
FIG. 8 PRIOR ART
FIG. 8 is a perspective view showing a fourth example of the conventional system.

FIG. 8 shows the fourth example of the conventional system. Different from the first to third examples shown in FIGS. 3 to 7, FIG. 8 shows a diagram for explaining an example of the fundamental operation of the carrying system. Namely, this diagram illustrates the case where objects 17*c*, 18*c*, and 19*c* to be conveyed such as woods or the like are individually pulled nearer from different directions (or from the same direction) by use of the cables 17, 18, and 19 which depend from a plurality of hoisting means (in this embodiment, three hoisting means 12, 13, and 14). In this case, since the swing arms 24, 25, and 26 of the cableway guiding means 30 are rotatably attached in the circumferential direction of the supporting rod 23, respectively, the swing arms 24 to 26 can be directed to the drawing works of the objects to be conveyed from desired directions, thereby enabling these swing arms to cope with the working positions, respectively.

With this constitution, the worker to perform the loading works to fix the objects to the hoisting cable and can sequentially execute the loading without spending waiting time. In the case of the full felling as well as the thinning, the felling woods inevitably locally exist in terms of the peculiarity of the forestry management. However, according to this example, the woods can be collected at a time from different directions in a desired region, so that the working efficiency is extremely improved. The present invention will now be described in detail with reference to FIGS. 9–11.

Figure 9:
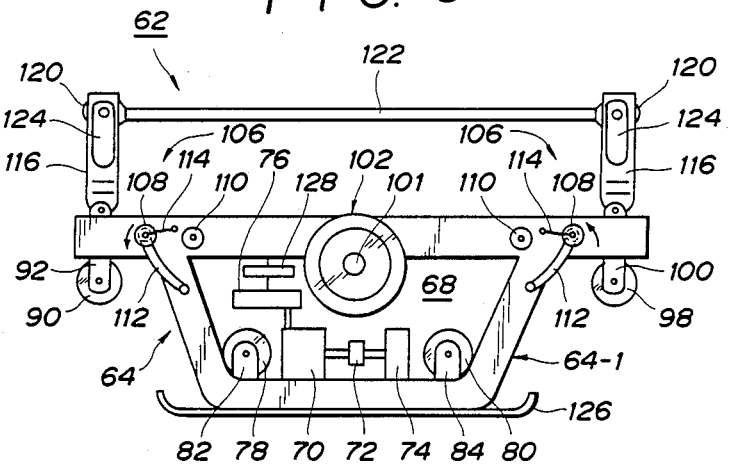
Figure 10:
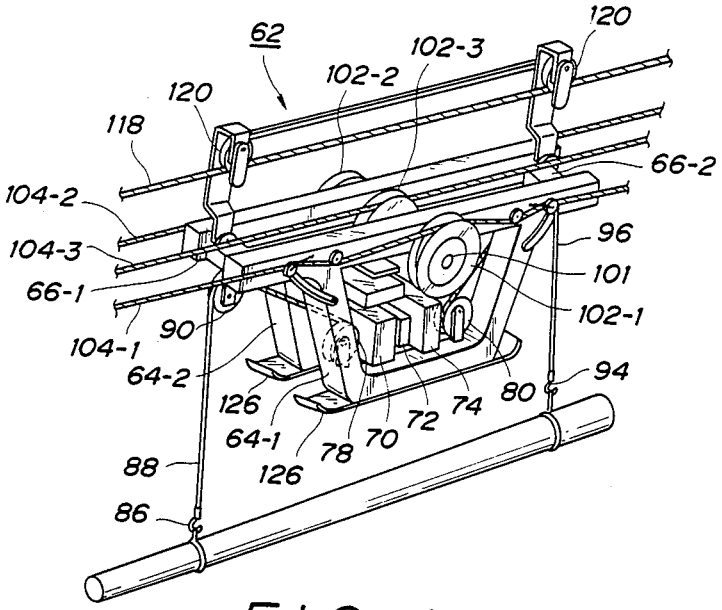

FIGS. 9 and 10 illustrate the first embodiment of the invention. A carrying apparatus 62 has two outer casings 64-1 and 64-2 which are arranged in parallel. Each of these outer casings has a hollow body and the functions as the tank for operating oil of a hydraulic apparatus 76 or as the tank for fuel oil of a power source 70, which will be explained hereinafter. Therefore, coupling portions 66-1 and 66-2 are formed in the upper portions on the sides of the front and rear ends of the outer casings 64-1 and 64-2 in order to allow the operating oil or fuel oil to flow therethrough. In this case, the upper surfaces of the coupling portions 66-1 and 66-2 are set so as to be slightly lower than the upper surfaces of the outer casings 64-1 and 64-2 in order to allow a sub cableway 104-3, which will be explained hereinafter, to pass over the coupling portions 66-1 and 66-2. On the other hand, other coupling portions (not shown) are also formed in the lower central portions of the oil or casings 64-1 and 64-2 in order to allow the operating oil or fuel oil to pass therethrough. A space 68 adapted to install the equipment such as a power source and the like is formed in each of the outer casings 64-1 and 64-2. Namely, the power source 70, a clutch 72, a speed change gear apparatus 74 such as an automatic speed change gear or the like, and the hydraulic apparatus 76 consisting of a hydraulic motor and the like are provided in the space 68. The power source 70, clutch 72, and speed change gear apparatus 74 are driven by the hydraulic apparatus 76. The power source 70 is connected to first and second hoisting means 78 and 80, which are respectively individually operated and controlled, through the clutch 72, speed change gear apparatus 74, and transferring means (not shown). The first and second hoisting means 78 and 80 are disposed in the central bottom portions of the outer casings 64-1 and 64-2 through first and second fixing devices 82 and 84.

As shown in FIG. 10, a first cable 88 having a first hook 86 at the free end is wound around the first hoisting means 78. The first cable 88 is vertically put down through the gap between the outer casings 64-1 and 64-2 and through a first guide pulley 90. The first guide pulley 90 is supported by a first pulley supporting bracket 92 connected to the lower portion of the coupling portion 66-1. Similarly, a second cable 96 having a second hook 94 at the free end is wound around the second hoisting means 80. The second cable 96 is vertically put down through the gap between the outer casings 64-1 and 64-2 and through a second guide pulley 98. For example, the second guide pulley 98 is supported by a second pulley supporting bracket 100 connected to the lower portion of the coupling portion 66-2. Therefore, by operating the first and second hoisting means 78 and 80, the objects to be carried can be suspended and laterally hung through the first and second cables 88 and 96.

A rotary shaft 101 is attached in the direction of width perpendicular to the longitudinal directions of the outer casings 64-1 and 64-2 by attaching means (not shown). Both end portions of the rotary shaft 101 are projected outwardly from the outside surfaces of these outer casings. A drive wheel 102-1 is attached to one end on the side of the outer casing 64-1. A drive wheel 102-2 is attached to the other end on the side of the outer casing 64-2. A drive wheel 102-3 is attached to the rotary shaft 101 at the position corresponding to the gap between the outer casings 64-1 and 64-2. Namely, the carrying apparatus 62 is constituted as one-shaft and three-bodies. The drive wheels 102-1 to 102-3 are coupled to the speed change gear apparatus 74 through transferring means (not shown). Sub cableways 104-1, 104-2, and 104-3 are wound around the drive wheels 102-1, 102-2, and 102-3 and are operated by these drive wheels, thereby moving the carrying apparatus 62. The sub cableways 104-1 to 104-3 are provided along a main cableway 118, which will be explained hereinafter. The edges of those sub cableways are fixed to fixing means such as standing trees, poles, or the like.

The sub cableways 104-1 to 104-3 wound around the drive wheels 102-1 to 102-3 are supported by a supporting mechanism 106. The supporting mechanism 106 has first and second supporting rollers 108 and 110. The first supporting roller 108 is attached to one end of a swing arm 112 and the other end of the swing arm 112 is axially supported, so that the roller 108 rotates around the other end of the swing arm 112 as a rotational center. One end of the swing arm 112 is pressed by a spring 114. The second supporting roller 110 is arranged closer at the side of the drive wheel 102 than the first supporting roller 108 and is fixed to the side portion of the outer casing 64. The drive wheels 102-1 to 102-3 are generally referred to as the drive wheel 102 hereinafter and the sub cableways 104-1 to 104-3 are also generally referred to as the sub cableway 104 hereinafter. The outer casings 64-1 and 64-2 are also generally referred to as the outer casing 64 hereinafter. When the sub cableway 104 is supported, the upper side of the sub cableway 104 contacts the lower side of the second supporting roller 110. The lower side of the sub cableway 104 contacts the upper side of the first supporting roller 108, thereby supporting the sub cableway 104. Thus, the second supporting roller 108 is moved by the pressing force of the sub cableway 104 against the pressing force of the spring 114 and supports the sub cableway 104. The supporting mechanism 106 having the above-mentioned constitution is disposed at four locations on both side portions of the outer casing 64, namely, on both front and rear end sides of both side portions of the outer casing 64.

Running wheel supporting brackets 116 are attached over the coupling portions 66-1 and 66-2 for coupling the outer casings 64-1 and 64-2. Running wheels 120 are attached to the brackets 116. The wheels 120 are guided by the main cableway 118 and run. The main cableway 118 is suspended along the sub cableway 104. The brackets 116 are coupled by a reinforcing member 122 disposed in parallel with and over the outer casing 64. Further, cableway slip-out preventing metal fittings 124 are attached to the end portions of the brackets 116.

On the other hand, cambers 126 for running are attached under the outer casings 64-1 and 64-2, thereby enabling the carrying apparatus 62 to be easily drawn and transported on the ground.

A receiver 128 to receive the radio waves is attached to the outer casing 64. Control commands received by the receiver 128 are sent to the hydraulic apparatus 76. By the hydraulic apparatus 76, the power source 70 is started, accelerated, or stopped, the clutch 72 is connected or disconnected, and the speed change gear apparatus 74 is switched. The operator who works at a safe unobstructed ground position operates a transmitter (not shown) to transmit the commands to the receiver 128 by the radio waves.

The operation of the first embodiment will now be described.

When the operator desires to operate the carrying apparatus 64, the operator operates the transmitter to transmit the radio waves to the receiver 128. In response to the radio waves received, the receiver 128 generates the control commands to the hydraulic apparatus 76. In response to the control commands, the hydraulic apparatus 76 drives the power source 70, clutch 72, and speed change gear apparatus 74. Thus, the rotary shaft 101 is rotated and each drive wheel 102 is driven. The carrying apparatus 62 is moved by the drive wheels 102 by operating the sub cableway 104. In this case, the wheels 120 are guided by the main cableway 118 and run therealong. After the carrying apparatus 62 is stopped at a desired position, the first and second hoisting means 78 and 80 are operated, thereby lifting the objects to be conveyed. The drive wheel 102 is again driven, the sub cableway 104 is operated, and the carrying apparatus 62 is moved to a desired position. In this manner, the conveyance of the object is completed.

When the object is hung, as shown in FIG. 10, both end portions of the object can be supported through the first and second cables 88 and 96. Therefore, the object is stably carried and the swing of the carrying apparatus 62 is prevented, so that the running performance is improved.

With the constitution of the first embodiment, the carrying apparatus is constituted by one-shaft and three-bodies. Thus, the friction which is generated by three drive wheels 102 and three sub cableways 104 can be large. Thus, the inconveniences such that the drive wheels 102 slip when the carrying apparatus 62 is obliquely upwardly drawn and the like can be avoided. When the carrying apparatus 62 is downwardly moved, it can be effectively braked. Thus, the operability is improved. On the other hand, since three sub cableways 104 are provided, the total weight of the carrying apparatus 62 and object which act on each sub cableway 104 can be reduced. It is possible to avoid that the sub cableways 104 are cut away. Even if one or two sub cableways 104 are cut away, the carrying apparatus 62 can be held at the fixed position by the remaining sub cableway 104 and main cableway 118, thereby preventing the carrying apparatus 62 from running recklessly and improving the safety. The attaching positions and the number of drive wheels 102 and the number of sub cableways 104 can be also changed in accordance with the location such as slanting ground, flat ground, or the like. Similarly, the sub cables 104 can be selectively used.

Figure 11:
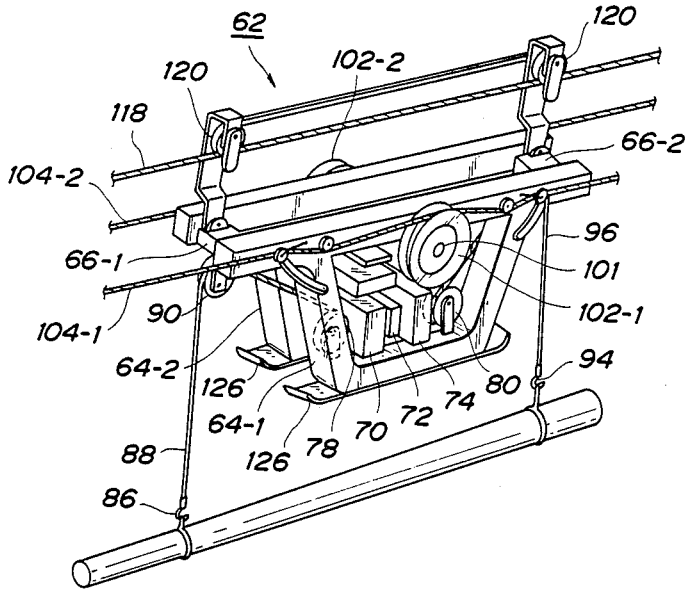
FIG. 11 illustrates a second embodiment of the present invention and is a perspective view of the state in which the carrying apparatus is suspended.

FIG. 11 illustrates the second embodiment of the invention. It is a feature of the second embodiment that the drive wheels 102-1 and 102-2 are attached to only both outside portions of the outer casings 64-1 and 64-2 and the sub cableways 104-1 and 104-2 are wound around these drive wheels.

With the constitution of the second embodiment, the effects similar to the first embodiment are obtained. The constitution is simple and the constitution of the second embodiment can be also easily applied to the conventional carrying apparatus and the carrying apparatus having one outer casing.

Although the present invention has been shown and described with respect to preferred embodiments, various changes and modifications which are obvious to a person skilled in the art to which the invention pertains are deemed to lie within the spirit and scope of the invention.

For example, although the foregoing embodiments have been constituted by one-shaft and three-bodies or one-shaft and two-bodies, the invention can be also constituted by one-shaft and four-bodies or one-shaft and multi-bodies.

On the other hand, the apparatus in the first and second embodiments of the invention can be constituted such as to have swing arms as shown in the conventional appartus.

As will be obvious from the above detailed description, according to the invention, one rotary shaft is provided, at least two drive wheels are attached to the rotary shaft, and the sub cableway is wound around each of the drive wheels. Thus, the frictions which are generated by the drive wheels and sub cableways can be enlarged. When the carrying apparatus is obliquely upwardly moved, it is possible to prevent that the carrying apparatus slips and the like. When the carrying apparatus is downwardly moved, the carrying apparatus can be effectively braked. The operating performance can be improved. On the other hand, the total weight of the carrying apparatus and object to be conveyed which act on each sub cableway can be reduced.

Therefore, it is possible to prevent that the sub cableways are cut away. Even if one of the sub cableways is cut away, the carrying apparatus can be held at the fixed position by the remaining sub cableways and main cableway, so that the safety is assured. Further, the sub cableways can be selectively wound around desired drive wheels and the use efficiency can be improved.

Moreover, if the carrying apparatus having swing arms is constituted as the single-shaft and a plurality of bodies, the functions of the swing arms can be sufficiently effected within a wide movement range owing to the strong driving force by the plurality of bodies. It is possible to avoid such an inconvenience that when the swing arms swing, a plurality of sub cableways are mixed and twisted and to prevent such accidents that the sub cableways are fatigued and deteriorate and are cut away and the like. The safety and working efficiency can be improved.

What is claimed is:

1. A radio control aerial automatic carrying system for carrying an object by a carrying apparatus suspended to a cableway, comprising:

an aerial main cableway which is suspended in a predetermined region;

running wheels engaged with said aerial main cableway;

a hollow outer casing suspended from said running wheels;

a power source mounted on said outer casing;

hoisting means mounted on said outer casing and driven by said power source, said hoisting means including hoisting cables to lift and lower an object to be carried;

a receiver, provided on said outer casing, for receiving radio waves which are transmitted from a transmitter and for generating control commands to drive said power source and said hoisting means in response to said radio waves as received;

a rotary shaft which is attached to said outer casing and rotated by said power source, said shaft extending generally horizontally in generally perpendicular relation to said main cableway;

at least two sub cableways which are suspended in parallel with said aerial main cableway for supporting said carrying apparatus; and at least two coaxially aligned drive wheels, attached to said rotary shaft, and respectively engaged with and having wound therearound a different one of said sub cableways for moving said carrying apparatus along said main cableway.

2. A carrying system according to claim 1, wherein said outer casing is constituted by first and second sidewardly spaced hollow outer casing portions which also serve as a tank for an operating liquid, said first and second outer casing portions are joined by coupling portions, a hydraulic apparatus for driving the power source, a clutch, a speed change gear apparatus, a first said hoisting cable is suspended from said outer casing through a first pulley mounted on one said coupling portion, and a second said hoisting cable is suspended from said outer casing through a second pulley mounted on another said coupling portion.

3. A carrying system according to claim 2, wherein first and second said drive wheels as mounted on said shaft are positioned adjacent outer sides of said first and second outer casing portions respectively, and first and second said sub cableways are wound around the first and second drive wheels.

4. A carrying system according to claim 3, wherein a third said drive wheel is mounted on said shaft and is positioned axially between said first and second drive wheels, said third drive wheel being positioned sidewardly between said first and second hollow outer casing portions, and a third said sub cableway extending parallel with said first and second sub cableways and being wound around said third said drive wheel.

5. A carrying system according to claim 1, wherein said outer casing has only a single said rotary shaft mounted thereon and provided with drive wheels thereon disposed in engagement with said sub cableways.

6. A carrying system according to claim 5, wherein first and second said drive wheels are mounted on said shaft and are positioned adjacent outer sides of said outer casing, and first and second said sub cableways are wound around the first and second drive wheels.

7. A carrying system according to claim 6, wherein said outer casing has sidewardly spaced casing portions, and wherein a third said drive wheel is mounted on said shaft and is disposed axially between said first and second drive wheels, said third drive wheel being positioned between the sidewardly-spaced casing portions, and a third said sub cableway extending generally parallel with said first and second sub cableways and being wound around said third drive wheel.

* * * * *